US007452182B2

(12) United States Patent
Vance et al.

(10) Patent No.: US 7,452,182 B2
(45) Date of Patent: Nov. 18, 2008

(54) MULTI-PIECE TURBINE VANE ASSEMBLY

(75) Inventors: Steven J. Vance, Orlando, FL (US); Allister W. James, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 608 days.

(21) Appl. No.: 11/101,249

(22) Filed: Apr. 7, 2005

(65) Prior Publication Data

US 2006/0228211 A1 Oct. 12, 2006

(51) Int. Cl.
*F01D 9/04* (2006.01)

(52) U.S. Cl. ..... 415/135; 415/136; 415/189; 415/200; 415/209.4

(58) Field of Classification Search ..... 415/135, 415/136, 137, 138, 189, 190, 200, 209.2, 415/209.3, 209.4
See application file for complete search history.

(56) References Cited

U.S. PATENT DOCUMENTS

| | | | | |
|---|---|---|---|---|
| 3,619,077 | A * | 11/1971 | Wile et al. | 415/115 |
| 3,867,065 | A | 2/1975 | Schaller et al. | |
| 3,992,127 | A | 11/1976 | Booher, Jr. et al. | |
| 4,006,999 | A | 2/1977 | Brantley et al. | |
| 4,861,229 | A | 8/1989 | Halstead | |
| 5,226,789 | A * | 7/1993 | Donges | 415/189 |
| 5,616,001 | A * | 4/1997 | Boyd | 415/209.2 |
| 5,931,636 | A | 8/1999 | Savage et al. | |
| 6,000,906 | A * | 12/1999 | Draskovich | 415/209.4 |
| 6,013,592 | A | 1/2000 | Merrill et al. | |
| 6,164,903 | A * | 12/2000 | Kouris | 415/135 |
| 6,200,092 | B1 | 3/2001 | Koschier | |
| 6,235,370 | B1 | 5/2001 | Merrill et al. | |
| 6,287,511 | B1 | 9/2001 | Merrill et al. | |
| 6,325,593 | B1 | 12/2001 | Darkins, Jr. et al. | |
| 6,331,217 | B1 | 12/2001 | Burke et al. | |
| 6,514,046 | B1 | 2/2003 | Morrison et al. | |
| 6,543,996 | B2 | 4/2003 | Koschier | |
| 6,607,358 | B2 | 8/2003 | Finn et al. | |
| 6,641,907 | B1 | 11/2003 | Merrill et al. | |
| 6,648,597 | B1 | 11/2003 | Widrig et al. | |
| 6,670,046 | B1 | 12/2003 | Xia | |
| 6,676,783 | B1 | 1/2004 | Merrill et al. | |
| 6,709,230 | B2 | 3/2004 | Morrison et al. | |
| 6,733,907 | B2 | 5/2004 | Morrison et al. | |
| 7,114,917 | B2 * | 10/2006 | Legg | 415/137 |

(Continued)

FOREIGN PATENT DOCUMENTS

| | | | |
|---|---|---|---|
| JP | 11141305 | A | 5/1999 |

*Primary Examiner*—Igor Kershteyn

(57) ABSTRACT

Aspects of the invention relate to a modular turbine vane assembly. The vane assembly includes an airfoil portion, an outer shroud and an inner shroud. The airfoil portion can be made of at least two segments. Preferably, the components are connected together so as to permit assembly and disassembly of the vane. Thus, in the event of damage to the vane, repair involves the replacement of only the damaged subcomponents as opposed to the entire vane. The modular design facilitates the use of various materials in the vane, including materials that are dissimilar. Thus, suitable materials can be selected to optimize component life, cooling air usage, aerodynamic performance, and cost. Because the vane is an assemblage of smaller sub-components as opposed to one unitary structure, the individual components of the vane can be more easily manufactured and more intricate features can be included.

7 Claims, 13 Drawing Sheets

U.S. PATENT DOCUMENTS

2002/0155269 A1 10/2002 Holowczak et al.
2004/0062636 A1 4/2004 Mazzola et al.
2004/0120811 A1* 6/2004 Darkins et al. ..... 415/191

* cited by examiner

MULTI-PIECE TURBINE VANE ASSEMBLY

FIELD OF THE INVENTION

The invention relates in general to turbine engines and, more specifically, to turbine vanes.

BACKGROUND OF THE INVENTION

During the operation of a turbine engine, turbine vanes, among other components, are subjected to a variety of loads. The vanes can be made of any of a number of materials, and each material can provide certain advantages in managing the operational loads imposed on the vane. Prior turbine vanes have been made of a single material. However, experience has demonstrated that no single material is ideal for every portion of the vane and that vanes made of a single material can actually lead to a decrease in engine efficiency. Prior vanes have also been formed with the airfoil portion and the shrouds as a unitary construction, such as by casting. Such unitary vanes can result in lower manufacturing yields, costly repair, and expensive replacement inventories. In addition, the relatively large size of the unitary vanes made the use of certain materials infeasible. Thus, there is a need for a vane design that can minimize these and other drawbacks associated with single material and/or unitary vane constructions.

SUMMARY OF THE INVENTION

Aspects of the invention relate to a modular vane assembly including a radially inner shroud, a radially outer shroud and an airfoil formed by at least one airfoil segment. The airfoil has a radial inner end and a radially outer end. The airfoil includes an outer peripheral surface defining a leading edge and a trailing edge. At least one of the inner shroud, the outer shroud and the airfoil is a separate part. The airfoil is secured between the inner and outer shrouds by a fastener extending substantially radially through the at least one airfoil segment and into engagement with the inner and outer shrouds. At least two of the radially inner shroud, the radially outer shroud and the airfoil can be made of different materials. In one vane assembly, the inner and outer shrouds can be made of CMC and the airfoil can be made of metal. Alternatively, the inner and outer shrouds can be made of metal, and the airfoil can be made of CMC.

In one embodiment, one end of the airfoil can be received within a recess in one of the inner and outer shrouds. The assembly can further include a seal provided between the recess and at least one of the radial end of the airfoil and the outer peripheral surface of the airfoil proximate the radial end. As a result, hot gas infiltration or cooling air leakage can be minimized. In such case, one or more of the airfoil segments, the inner shroud and/or the outer shroud can be made of intermetallics, Oxide Dispersion Strengthened (ODS) alloys, single crystal metals, advanced superalloys, metal matrix composites, ceramics or CMC.

The fastener can include opposing ends. At least one end of the fastener can include a shoulder with a shaft extending therefrom. The shaft can be threaded. The shoulder can engage one of the shrouds, and the shaft can extend through at least a portion of the shroud. Such an fastener system can substantially prevent pre-tensioning of the airfoil segment.

The assembly can include a metal inner shroud support provided substantially adjacent to the radially inner face of the inner shroud and a metal outer shroud support provided substantially adjacent to the radially outer face of the outer shroud. The fastener can have opposing ends such that the fastener extends through the inner and outer shrouds and is secured at each end to a respective shroud support. Thus, the shroud supports and fastener can form a rigid substructure for supporting mechanical loads imposed on the vane assembly during engine operation. In such case, at least one of the inner shroud, the outer shroud and at least one of the airfoil segments is made of CMC. That is, only one component of this group of components (the inner shroud, the outer shroud and the one or more airfoil segments) can be made of CMC, all of these components can be made of CMC, or two or more of the components from this group of components can be made of CMC.

In one embodiment, the airfoil can be formed by at least two airfoil segments including at least a forward airfoil segment and an aft airfoil segment. The forward airfoil segment can define the leading edge of the airfoil assembly; the aft airfoil segment can define the trailing edge of the airfoil assembly. The aft airfoil segment can be made of metal. In such case, the other of the airfoil segments can be made of CMC. The aft airfoil segment can have opposing ends. One end of the aft airfoil segment can be fixed to a respective shroud, and the opposite end of the aft airfoil segment can be received within a recess in the outer shroud. The forward airfoil segment can be secured to the shrouds by the fastener. The airfoil segments, the inner shroud and/or the outer shroud can be made of one of intermetallics, Oxide Dispersion Strengthened (ODS) alloys, single crystal metals, superalloys and metal matrix composites. Each of these components can be made of one of the listed materials, only one of the components can be made of one of the listed materials, or more than one of the components can be made of any one of the listed materials.

In one embodiment, one or more intermediate airfoil segments can be disposed between the forward and aft airfoil segments. In such case, at least one of the forward airfoil segment, the intermediate airfoil segment, the inner shroud and the outer shroud can be made of CMC. That is, only one of these components (the forward airfoil segment, the intermediate airfoil segment, the inner shroud or the outer shroud) can be made of CMC, all of these components can be made of CMC, or two or more of these components can be made of CMC.

Each airfoil segment can include an interface surface. The airfoil segments can be positioned such that interface surfaces are substantially proximate to each other so as to define a gap between the interface surfaces. In one embodiment, a seal can be placed within the gap so as to substantially minimize flow migration through the gap. In another embodiment, the interface surfaces of the airfoil segments can be substantially correspondingly stepped so as to form a tortuous flow path through the gap. In yet another embodiment, the substantially proximate airfoil segments can define a radial seam, and the airfoil segments can be welded along the radial seam. Thus, flow ingress into the gap can be substantially impeded.

In other respects, aspects of the invention relate to a modular vane assembly with a sliding airfoil segment. The assembly includes a first shroud, a second shroud and an airfoil. The airfoil has a radial first end and a radial second end. The airfoil is formed by at least two airfoil segments including a forward airfoil segment and an aft airfoil segment. The forward airfoil segment defines the leading edge of the airfoil, and the aft airfoil segment defines the trailing edge of the airfoil.

The first radial end of one of the airfoil segments is fixed to the first shroud. In one embodiment, the first radial end can be fixed to the first shroud by one of welding, mechanical engagement or fasteners. Alternatively, the first radial end and the first shroud can be unitary. The second radial end of the airfoil segment is received within a recess in the second shroud. Thus, the airfoil segment is allowed to thermally expand in the radial direction while being substantially restrained in the axial and circumferential directions by the shroud and the neighboring airfoil segment.

Aspects of the invention further relate to an vane assembly with segmented airfoil. The assembly includes a radially inner shroud, a radially outer shroud and an airfoil.

The airfoil has a radially inner end and a radially outer end. The airfoil is formed by at least an arcuate forward airfoil segment and a second airfoil segment. The forward airfoil segment defines the leading edge of the airfoil. In one embodiment, the forward segment can be made of a single crystal material. The forward airfoil segment is positioned substantially proximate to and is attached to the second airfoil segment. Thus, the airfoil is secured between the radially outer shroud and the radially inner shroud. A gap can be defined between the forward airfoil segment and the second airfoil segment. The gap can be substantially sealed by brazing the forward airfoil segment and the second airfoil segment.

In one embodiment, at least one of the shrouds can include a recess shaped to receive at least a respective end of the airfoil. This end of the airfoil can be secured to the shroud by a fastener. In another embodiment, each of the inner and outer shrouds can include a recess shaped to receive the respective radial ends of the airfoil. The radial ends of the airfoil can be received within the recesses. A fastener can extend through the second segment and engages the shrouds. At least one end of the fastener can be closed with a retainer and a radial spring is disposed between the retainer and one of the shrouds.

DETAILED DESCRIPTION OF EMBODIMENTS OF THE INVENTION

Figure 1:
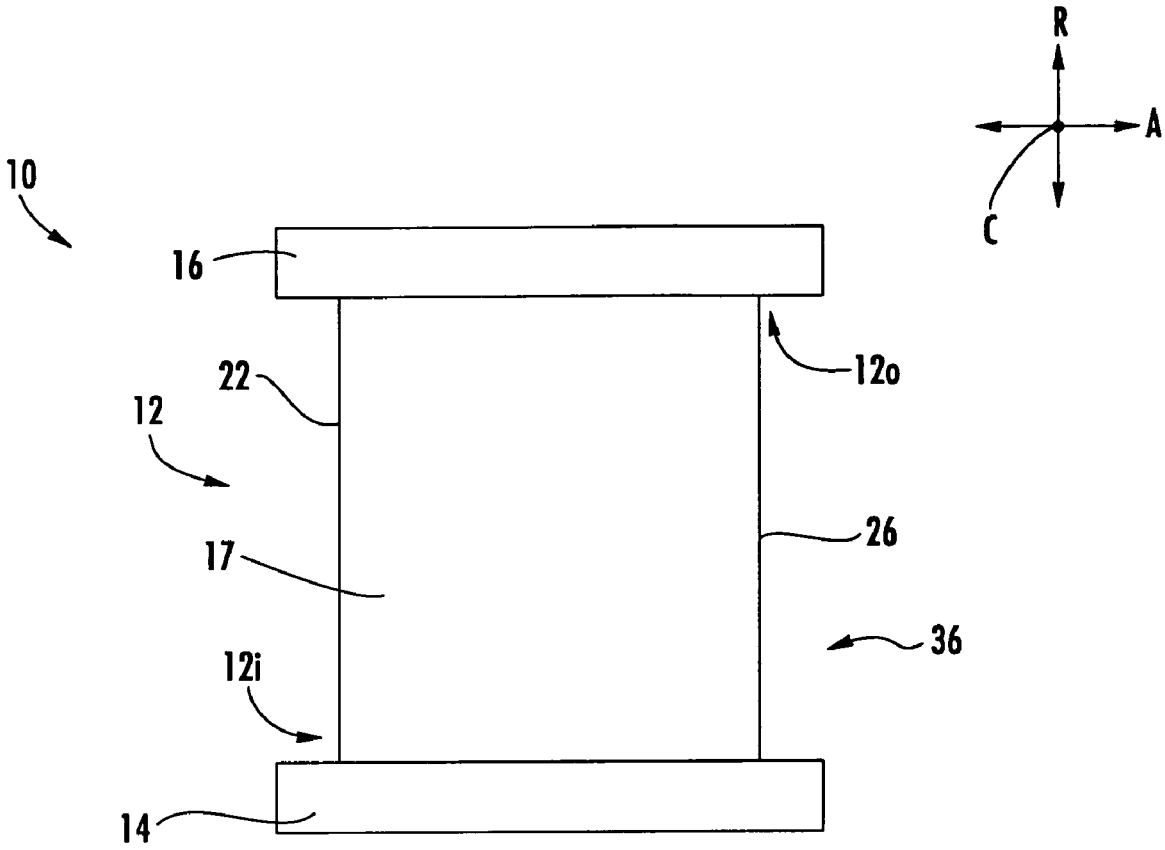
FIG. 1 is a side elevational view of a vane assembly according to embodiments of the invention, showing a single segment airfoil.

Embodiments of the present invention provide a modular vane assembly. Embodiments of the invention will be explained in the context of various possible vane assemblies, but the detailed description is intended only as exemplary. Embodiments of the invention are shown in FIGS. 1-16, but the present invention is not limited to the illustrated structure or application.

A vane assembly 10 according to aspects of the invention can have several separate sub-components. The vane assembly 10 can include at least an airfoil portion 12, an inner shroud 14 and an outer shroud 16. According to embodiments of the invention, at least one of the airfoil 12, inner shroud 14 or outer shroud 16 can be separately formed. In one embodiment, each of these components 12, 14, 16 can be separately formed and then subsequently assembled to form the vane assembly 10. In some instances, some of these components can be formed as a unitary construction. For example, the airfoil 12 can be unitary with one of the shrouds 14, 16, while the other shroud is a separately formed. Each of these components will be discussed in turn below.

The airfoil portion 12 can be formed by at least one airfoil segment. The airfoil portion 12 can have a radially inner end 12*i* and a radially outer end 12*o*. The term "radial," as used herein, is intended to mean radial to the turbine when the vane assembly is installed in its operational position. Each segment can be elongated in the radial direction R. The airfoil 12 can include a leading edge 22 and a trailing edge 26 as well as an outer peripheral surface 36.

Figure 2:
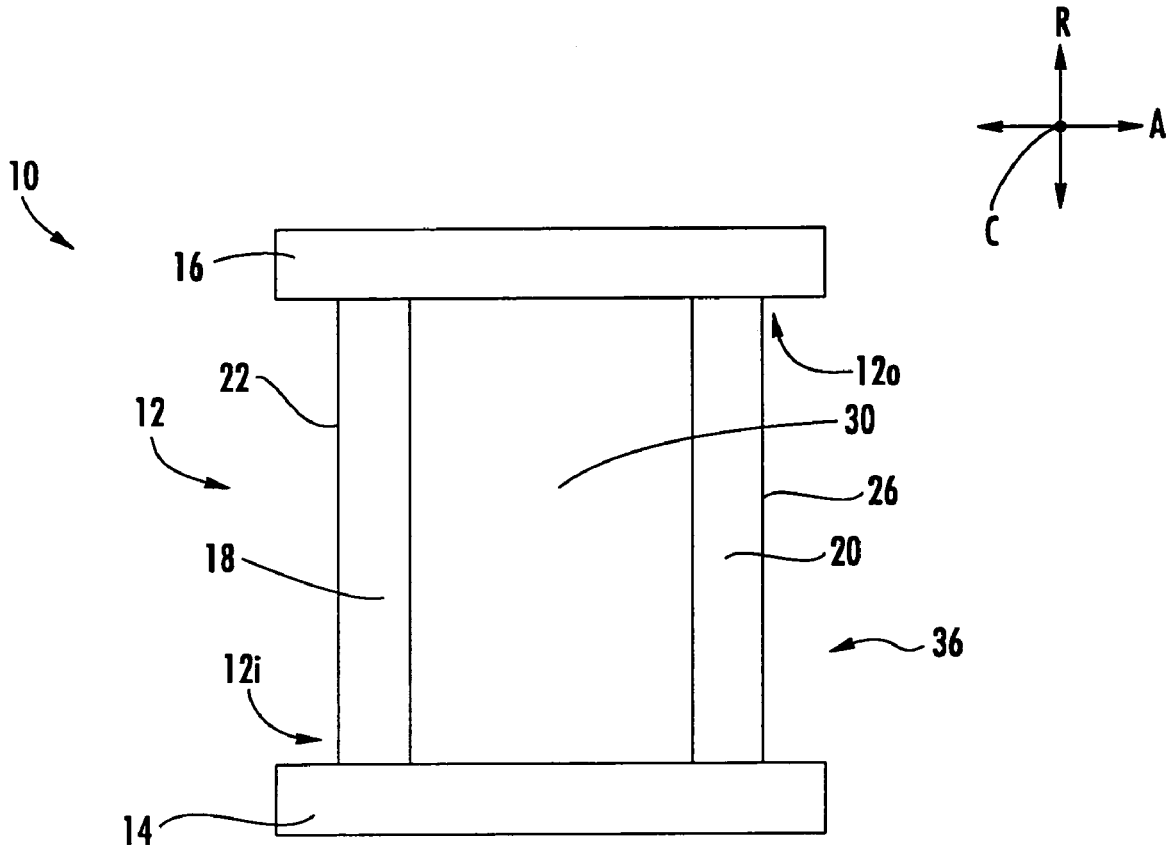
FIG. 2 is a side elevational view of a vane assembly according to embodiments of the invention, showing an airfoil made of three segments.
Figure 3:
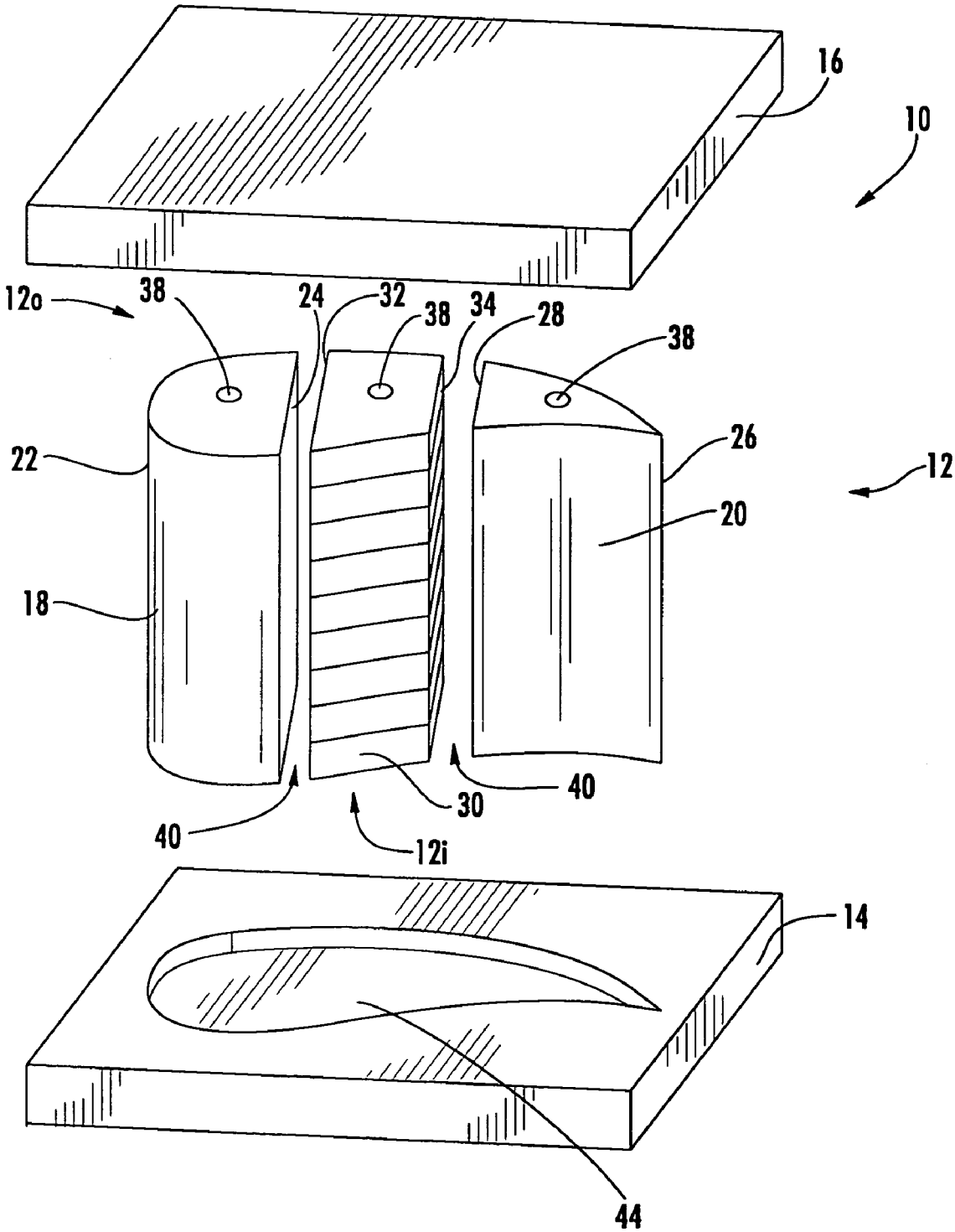
FIG. 3 is an exploded isometric view of a vane assembly according to embodiments of the invention.

In one embodiment, the airfoil 12 can be a single airfoil segment 17, as shown in FIG. 1. In another embodiment, the airfoil 12 can be formed by three segments, as shown in FIG. 2. To facilitate explanation, the following discussion will be directed to a three segment airfoil segment unless otherwise noted. However, embodiments of the invention are not limited to airfoils made of three segments. It will be understood that the following discussion can be readily applied to an airfoil portion having fewer or more segments.

In any airfoil made of two or more individual segments, the airfoil portion 12 can include a forward segment 18 and an aft segment 20. The terms "forward" and "aft" refer to the position of the segments 18, 20 relative to the oncoming gas flow in the turbine. One end of the forward segment 18 can define the leading edge 22 of the airfoil portion 12. The opposite end of the forward segment 18 can provide an interface surface 24. The interface surface 24 can have any of a number of configurations. In one embodiment, the interface surface 24 can be substantially flat.

The aft segment 20 can define the trailing edge 26 of the airfoil portion 12. The aft segment 20 can culminate in the trailing edge 26 at one end. At the opposite end, the aft segment 20 can provide an interface surface 28. The interface surface 28 can have any of a number of configurations, such as substantially flat or rounded.

An intermediate segment 30 can be disposed between the forward and aft segments 18, 20. The intermediate segment 30 can provide an interface surface 32 at one end and another interface surface 34 at the other end. The individual segments 18, 20, 30 can have various shapes, but when they are assembled according to aspects of the invention, they form the substantially airfoil-shaped outer peripheral surface 36. The segments 18, 20, 30 can be substantially identical in length in the radial direction R or in the axial/circumferential directions A, C relative to the turbine. But, in some instances, it may be advantageous for at least one of these segments to be a different length in any of these directions R, A, C.

One or more radial passages 38 can extend radially through at least one of the airfoil segments 18, 20, 30. The passages 38 can be provided for various purposes including, for example, to provide cooling to the segment or to accommodate a fastener. Each passage 38 can serve a single purpose or can serve multiple purposes. The passages 38 can have any of a number of shapes and sizes, and may or may not be constant along the radial length of the passage. In one embodiment, the passages 38 can be substantially circular.

Each airfoil segment 18, 20, 30 can have any of a number of configurations. For instance, one or more of the airfoil segments 18, 20, 30 can be a unitary construction. For example, one entire segment can be cast as a single part. However, at least one of the segments 18, 20, 30 can be made of two or more pieces. For instance, a segment can be made of a plurality of wafers that are stacked in the radial direction R (see, for example, intermediate segment 30 in FIG. 3). Alternatively, the segment can be made of two or more pieces that are joined together by any of a number of ways including welding, brazing, mechanical engagement, or fasteners. The segments 18, 20, 30 can be substantially solid, or they can be hollow.

Each airfoil segment 18, 20, 30 can be made of any of a number of materials. In one embodiment, the airfoil segments 18, 20, 30 can be made of all the same material. However, at least one airfoil segment 18, 20, 30 can be made of a different material. For example, at least one of the airfoil segments 18, 20, 30 can be made of metal, metal matrix composite (MMC), ceramic, or a ceramic matrix composite material (CMC). It should be noted that in the case of a CMC segment, embodiments of the invention are not limited to any particular fiber architecture or orientation in the segment. Preferably, the aft segment 20 is made of metal and at least one of the other segments 18, 30 is made of CMC. In one embodiment, the airfoil portion 12 can be made of metal, and the inner and outer shrouds 14, 16 can be made of CMC.

A multi-piece vane 10 according to embodiments of the invention can include materials that have been heretofore infeasible to include in a turbine vane due to manufacturing and other considerations. Examples of such materials include intermetallics, Oxide Dispersion Strengthened (ODS) alloys, single crystal metals, and advanced nickel-based superalloys, just to name a few possibilities. It will be understood that the material selection for an airfoil segment can affect the manner in which the segment is made. For instance, a metal segment can be formed by casting whereas a CMC segment can be formed by hand lay-up.

When assembled, the segments 18, 20, 30 can be positioned substantially proximate to each other. More specifically, the interface surface 24 of the forward segment 18 can be positioned substantially proximate to the interface surface 32 of the intermediate segment 30, and the interface surface 34 of the intermediate segment 30 can be positioned substantially proximate to the interface surface 28 of the aft segment 20. Gaps 40 can be defined between the pair of substantially proximate interface surfaces. Depending on the compatibility of the materials making up each of the segments 18, 20, 30, the segments 18, 20, 30 may or may not be directly attached to each other. In instances where adjacent segments have substantially different coefficients of thermal expansion, such as when one segment is made of metal and another segment is made of CMC, the segments 18, 20, 30 can remain detached from each other.

During engine operation, it is unacceptable to have gaps 40 between the airfoil segments 18, 20, 30. If present, there is potential for hot gases in the turbine to flow through the gap 40 due to the large pressure differentials between the pressure side P and the suction side S of the vane assembly 10. As a result, there can be appreciable reductions in aerodynamic performance as well as additional cooling issues to address.

Figure 4:
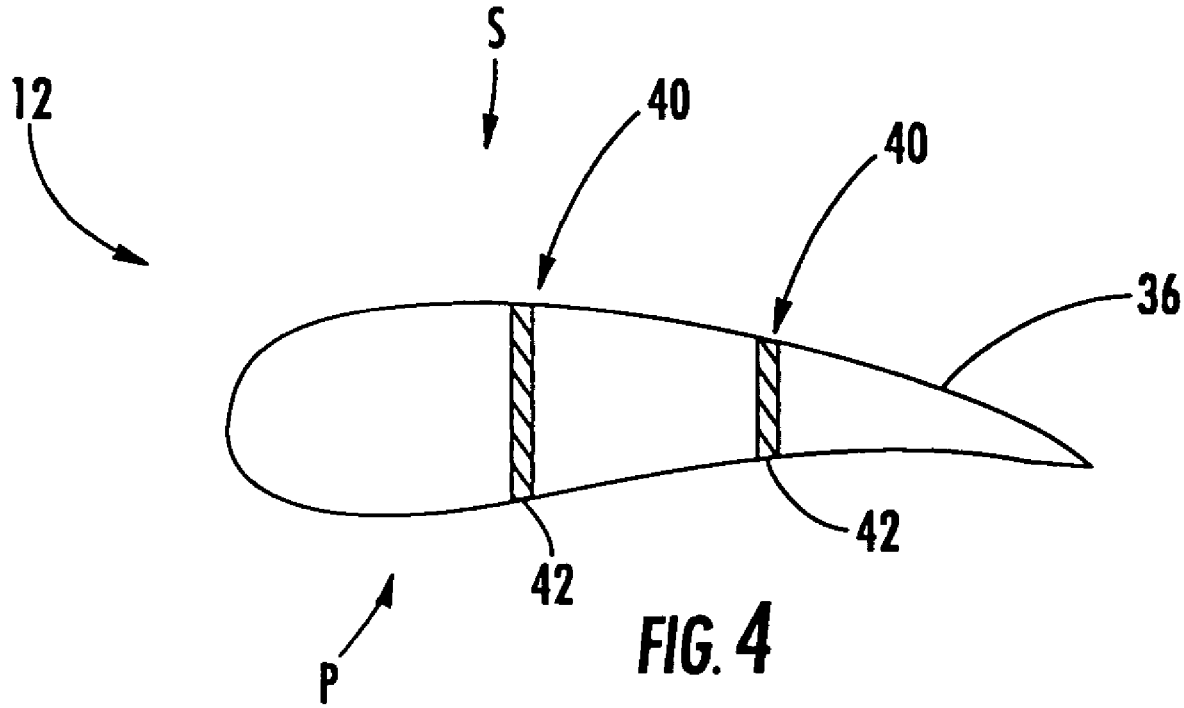
FIG. 4 is a top plan view of an airfoil portion of a vane assembly according to embodiments of the invention, showing seals disposed in the gaps between the airfoil segments.
Figure 5:
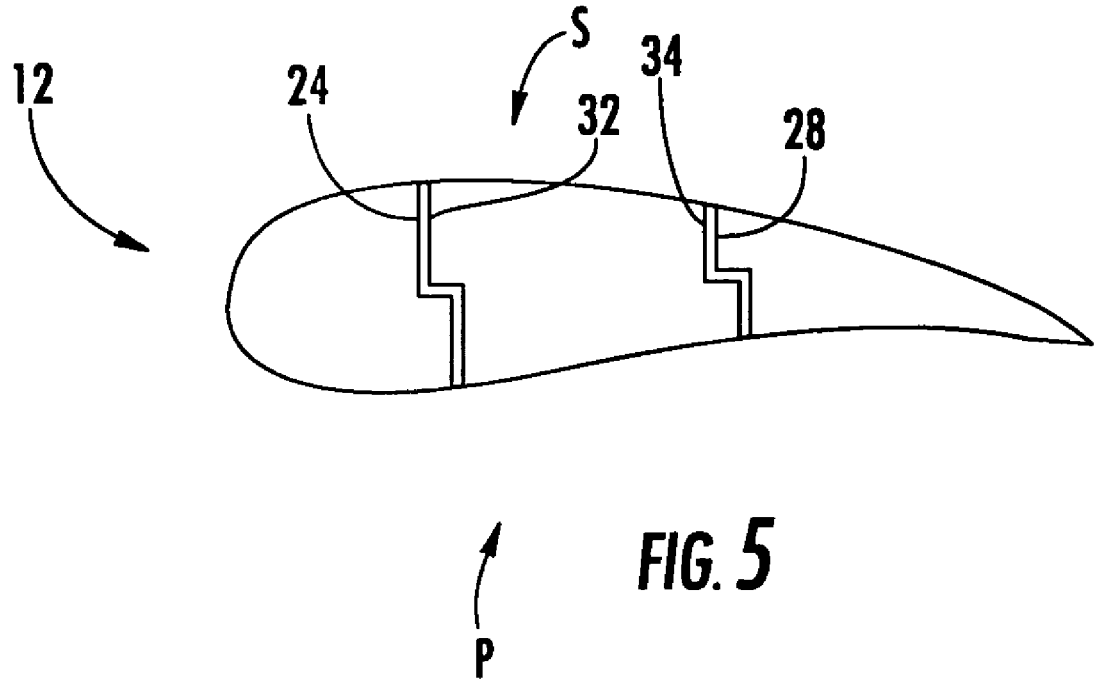
FIG. 5 is a top plan view of an airfoil portion of a vane assembly according to embodiments of the invention, showing airfoil segments with stepped interface surfaces.

There are various ways in which flow potential through the gaps 40 can be minimized. In one embodiment, the gaps 40 can be substantially obstructed. For example, the airfoil segments 18, 20, 30 can be brazed or welded along their radial interface at or near the outer peripheral surface 36 so as to close the gaps 40. Alternatively, the gaps 40 can be filled with a compliant insert or other seal 42 (rope seal, tongue and groove seal, sliding dove-tail, etc.) to prevent hot gas ingress and migration through the gaps 40, as shown in FIG. 4. The seal 42 may or may not be secured to at least one of the interface surfaces forming the gap 40. Yet another possibility is to configure the gaps 40 so as to create a longer and tortuous flow path therethrough. For instance, the interface surfaces 24, 32, 34, 28 of the segments 18, 20, 30 can include one or more steps, as shown in FIG. 5. These and other systems can be used to reduce flow potential through any gaps between airfoil segments.

Figure 12:
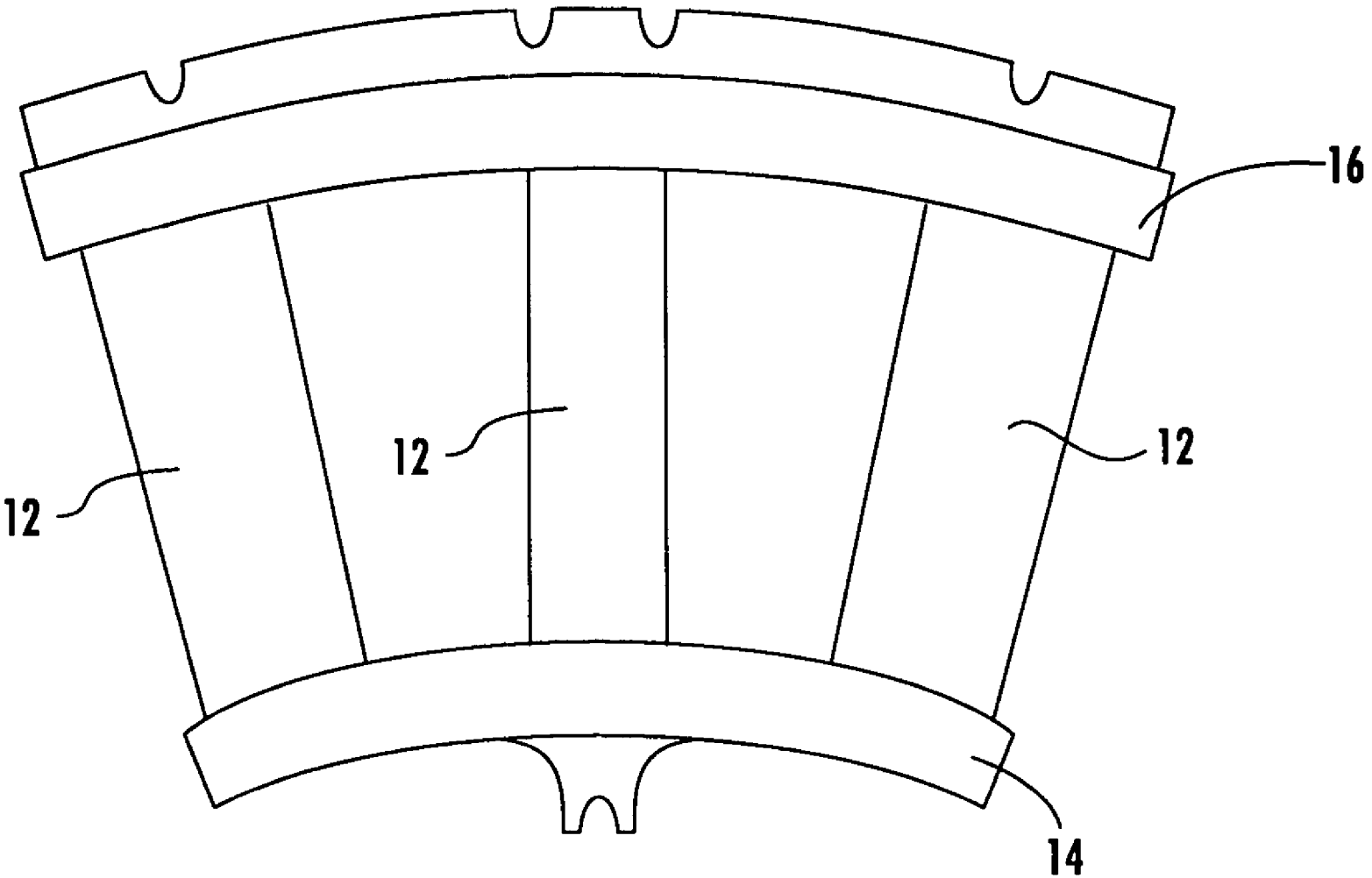
FIG. 12 is a front elevational view of a vane assembly according to embodiments to the invention, showing three airfoil portions spanning between inner and outer shrouds.

Aside from the airfoil portion 12, the vane assembly 10 according to embodiments of the invention can further include a radially outer shroud 16 and a radially inner shroud 14. The terms "radially inner" and "radially outer" are intended to refer to the operational positions of each shroud with respect to the turbine. The outer shroud 16 can facilitate attachment to a surrounding stationary support structure, such as a vane carrier. The inner shroud 14 can be adapted to host a seal housing or other structure. A vane assembly according to aspects of the invention can facilitate the formation of a rigid structure that is suitable for supporting the inner stage seal housing, such as on turbine row 2, as will be discussed in detail below. The shrouds 14, 16 may bound the radial ends of a single airfoil portion or multiple airfoil portions. In one embodiment, the inner and outer shrouds 14, 16 can accommodate three airfoil portions 12, as shown in FIG. 12.

The inner and outer shrouds 14, 16 can be unitary structures or, like the airfoil portion 12, the inner and outer shrouds 14, 16 can be made of two or more segments. The shrouds 14, 16 can have any of a number of conformations, and embodiments of the invention are not limited to any particular geometry. In one embodiment, the shrouds 14, 16 can be generally arcuate. The shrouds 14, 16 can be made of any of a number of materials including CMC. The inner and outer shrouds 14, 16 can be made of the same material, or they can be made of different materials. In one embodiment, the inner and outer shrouds 14, 16 are made of metal.

Figure 8:
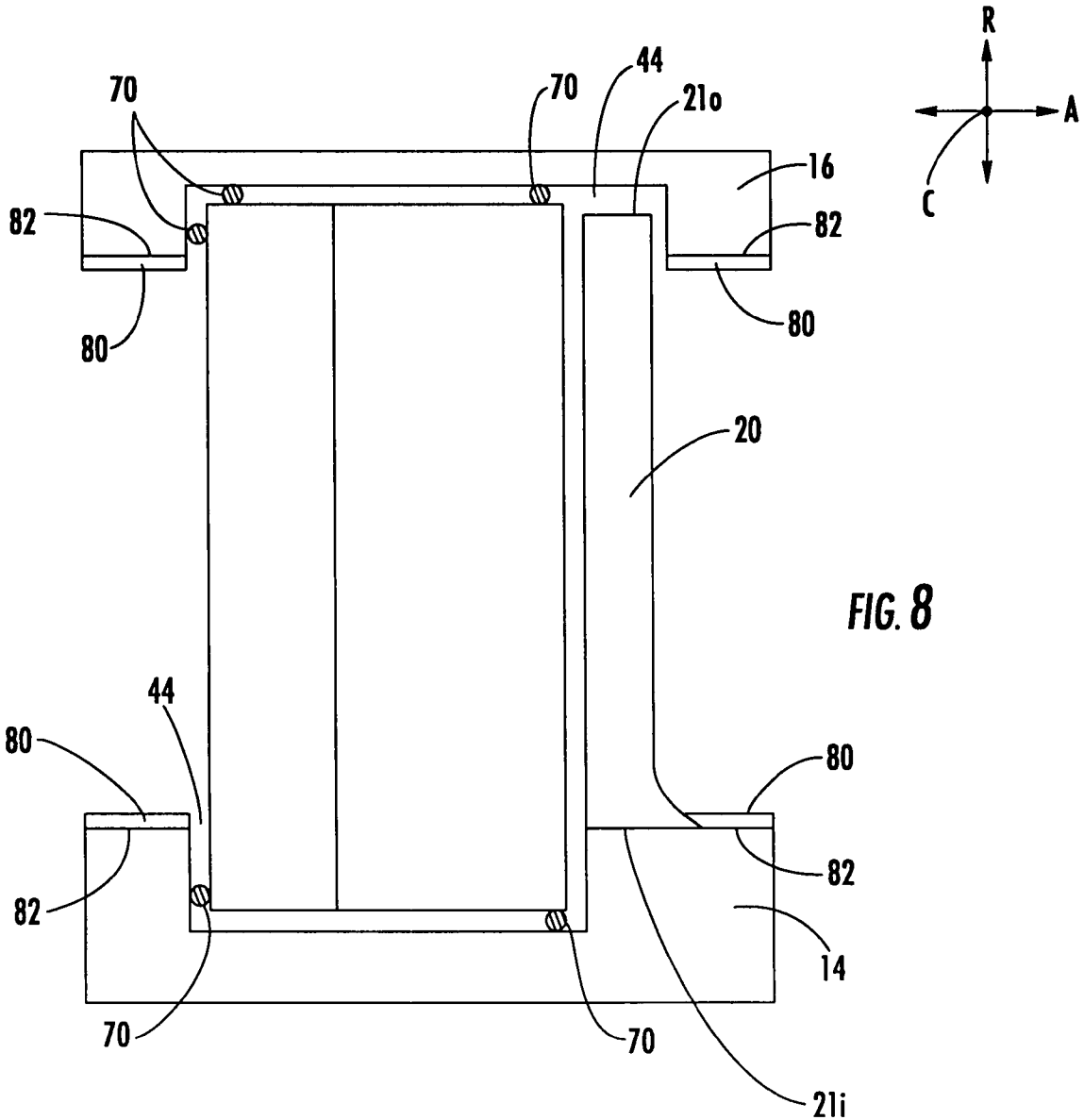
FIG. 8 is a partial cross-sectional side view of a vane assembly according to embodiments of the invention.

The airfoil segments 18, 20, 30 can operatively interface with the shrouds 14, 16 in any of a number of ways. For example, at least one of the airfoil segments 18, 20, 30 can be integral with one of the shrouds 14, 16 by, for example, welding, brazing or fasteners. In one embodiment, the aft airfoil segment 20 can be welded at one end to a respective shroud. For example, the radially inner end 21*i* of the aft segment 20 can be welded to the inner shroud 14, as shown in FIG. 8.

Alternatively, at least one of the shrouds 14, 16 can be adapted to receive a portion of the airfoil segments 18, 20, 30 including the radial ends. For example, each shroud 14, 16 can include a recess 44. There can be a single recess 44 to receive a radial end of the airfoil assembly 10, or there can be more than one recess 44 to receive one or more individual airfoil segments 18, 20, 30. The recess 44 can be sized and shaped to substantially correspond to the outer peripheral surface 36 of an airfoil assembly 12 or an individual airfoil segment 18, 20, 30. As a result, it will be appreciated that the recess 44 can constrain the airfoil portion 12 in the axial and circumferential directions A, C relative to the turbine.

Figure 6:
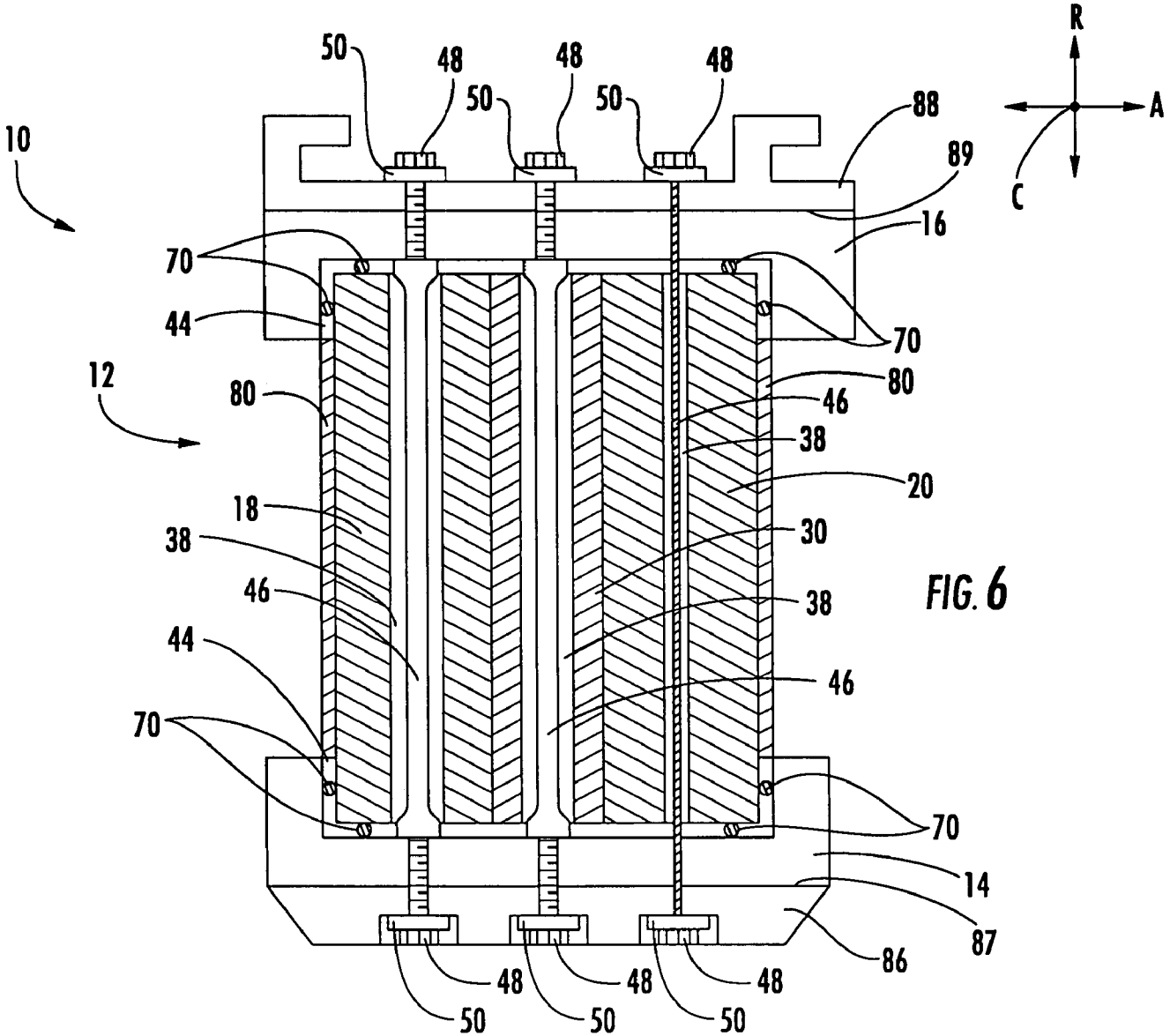
FIG. 6 is a cross-sectional view through a vane assembly according to embodiments of the invention.
Figure 7:
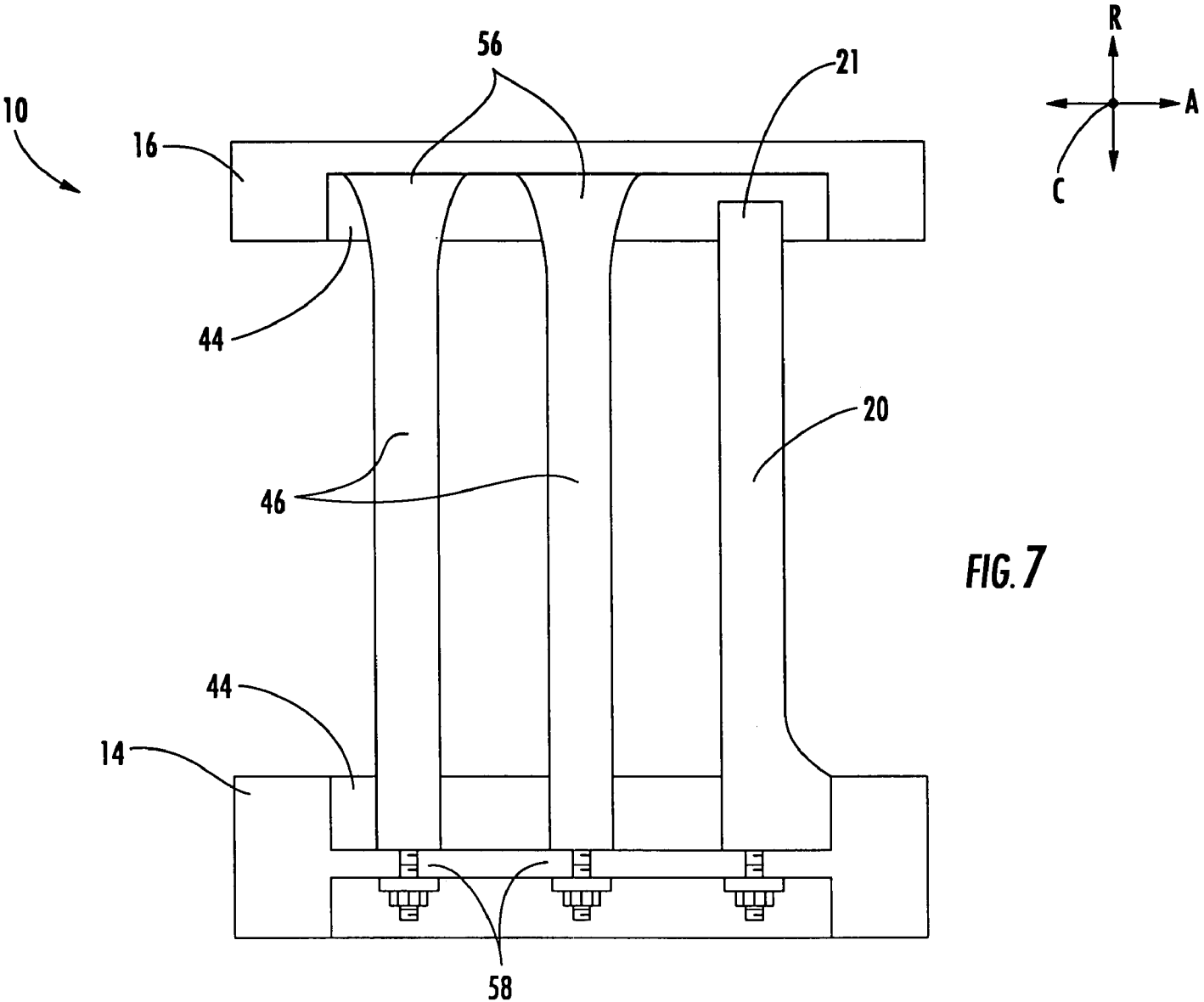
FIG. 7 is a partially exploded cross sectional view of a vane assembly according to embodiments of the invention.

Additional securement of the airfoil portion 12 to the shrouds 14, 16 can be provided. In one embodiment, at least one of the airfoil segments 18, 20, 30 can be secured to the shrouds 14, 16 by one or more fasteners. For instance, as shown in FIGS. 6 and 7, an elongated fastener 46, such as a bolt, bar, rod, or spar, can pass substantially radially through the passage 38 provided in the airfoil segments 18, 20, 30. Preferably, the fastener 46 is made of metal. The ends of the fastener can extend into and possibly beyond the outer and inner shrouds 14, 16 and can include a retainer at each end to prevent movement of the fastener 46. The retainer can be, for example, a nut 48 or a fastener head. Other hardware can be used in connection with the retainers, such as washers 50 to provide a sufficient clamping surface or spring washers to provide compliance. In addition to joining the shrouds 14, 16 to the airfoil portion 12, the fasteners 46 can also be used to hold multi-part shrouds together and/or to attach additional hardware to the shrouds 14, 16.

Figure 9:
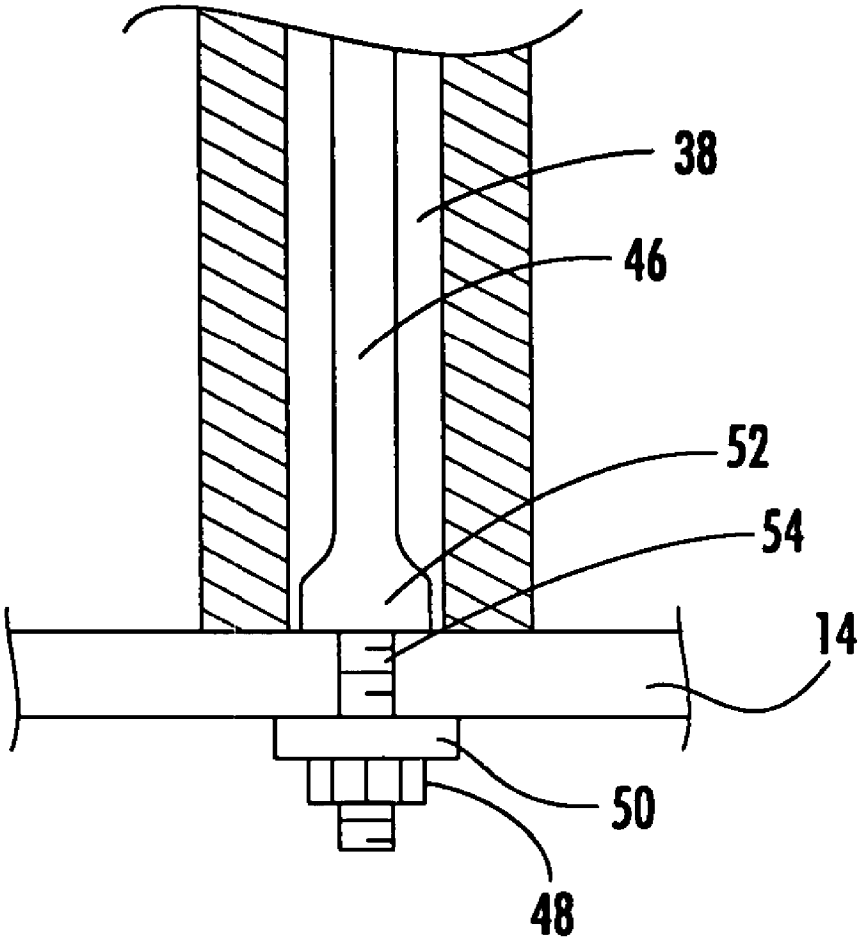
FIG. 9 is a close-up view of a fastener with a shoulder at one end according to embodiments of the invention.

It should be noted that when an airfoil segment is made of CMC or other composite, especially when the fibers are substantially aligned in the radial direction R, in-plane compressive loads imposed by the fastener 46 on the airfoil segment can lead to micro buckling and subsequent interlaminar failure in the segment. To avoid such concerns, the fasteners 46 can include a shoulder 52 to allow for rigid assembly without pre-loading the CMC airfoil segment. The shoulder 52 can be provided on one or both ends of the fastener 46. As shown in FIG. 9, one end of the fastener 46 can include a shoulder 52 with a threaded shaft 54 extending therefrom. The treaded portion 54 can pass through an opening in the shroud 14 and can be held with a retainer on the outside of the shroud 14.

In one embodiment, at least one end of the fastener 46 can be integral with a respective shroud 14, 16. For example, as shown in FIG. 7, the radially outer end 56 of the fastener 46 can be welded to the outer shroud 16. The radial inner end 58 of the fastener 46 can be secured to the inner shroud 14 by one or more fasteners in any of the manners discussed above.

In one embodiment, one end of an airfoil segment may be disconnected to a respective shroud so as to allow the end of the airfoil segment to "float." That is, by leaving the end of the airfoil segment unattached, differential radial thermal expansion between the airfoil segment and the shrouds and/or other airfoil segments can be accommodated. One example of an airfoil segment with a floating end is shown in FIGS. 7 and 8. As shown, the radially outer end 21*o* of the aft airfoil segment 20 can be received in the recess 44 provided in the outer shroud 16. The radially free outer end 21*o* can be substantially restrained in the axial and circumferential directions by the walls of the recess 44 and possibly by a substantially proximate airfoil segment. However, because the radially outer end 21*o* of the aft airfoil segment 20 is not attached to the outer shroud 16, radial thermal expansion of the aft segment 20 is permitted. Naturally, the depth of the recess 44 and the amount which the aft airfoil segment 20 extends into the recess 44 in the cold condition can be sized with an understanding of the thermal behavior of the materials of the airfoil segment 20 and the shroud 16 during engine operation.

Regardless of the specific manner in which the airfoil segments 18, 20, 30 are attached to the shrouds, the hot gases in the turbine must be prevented from infiltrating into any spaces between the recesses in the shrouds and the airfoil segments 18, 20, 30 so as to prevent undesired heat inputs and to minimize flow losses. Also, in instances where any of the airfoil segments 18, 20, 30 are internally cooled with a coolant at a higher pressure than the hot combustion gases, excessive coolant leakage into the hot gas path can occur. To minimize such concerns, one or more seals 70 can be provided. The seals can be at least one of rope seals, W-shaped seals, C-shaped seals, E-shaped seals, a flat plate, and labyrinth seals. The seals 70 can be made of various materials including, for example, metals and ceramics.

Figure 10:
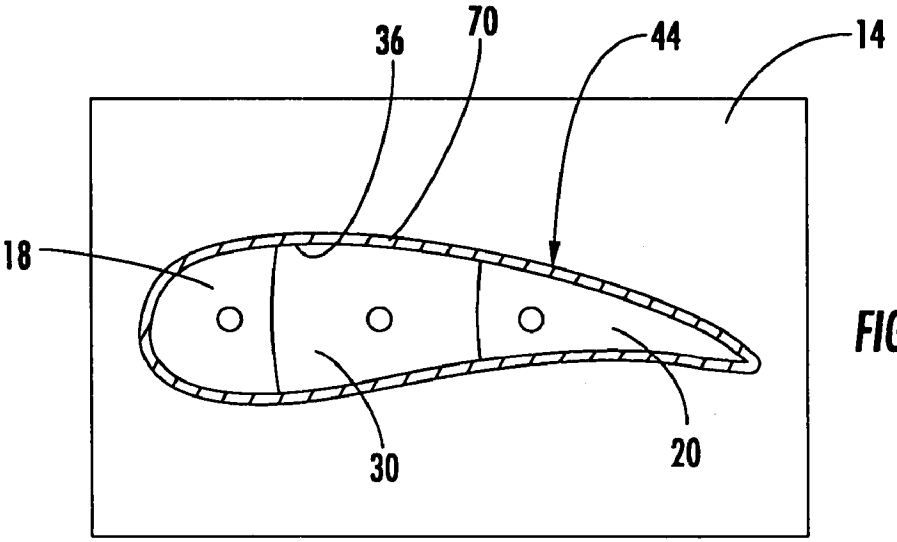
FIG. 10 is a top plan view of a sealing system between the outer peripheral surface of an airfoil portion and a shroud according to embodiments of the invention.
Figure 11:
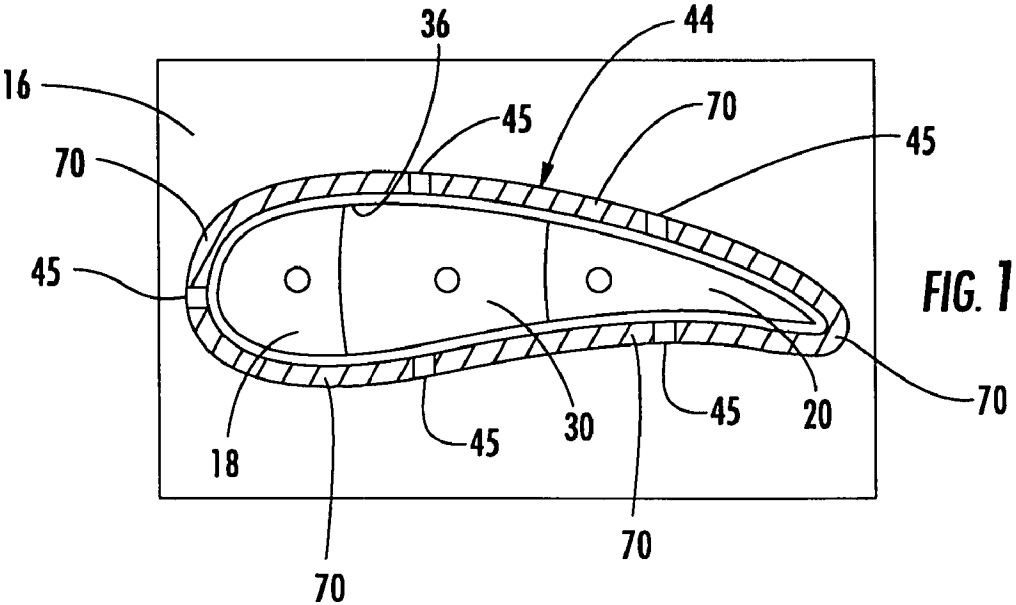
FIG. 11 is a top plan view of another sealing system between the outer peripheral surface of an airfoil portion and a shroud according to embodiments of the invention.

The seals 70 can be placed in various locations. In one embodiment, the seals 70 can be placed about the entire interface between the outer peripheral surface 36 of the airfoil portion 12 and the recess 44, as shown in FIG. 10. Alternatively, one or more seals 70 can be placed at various locations between the outer peripheral surface 36 of the airfoil portion 12 and the recess 44, as shown in FIG. 11. In such case, the seals 70 can abut each other or there can be a gap 45 between a pair of neighboring seals 70. Alternatively or in addition, one or more seals 70 can be placed in at least a portion of the space between the radial ends 12*i*, 12*o* of airfoil portion 12 and the recess 44, as shown in FIGS. 6 and 8. Further, the seals 70 can be provided in a cooperative arrangement between the recess 44 and the outer peripheral surface 36 of the airfoil 12 as well as between the recess 44 and the radial end 12*i*,12*o* of the airfoil 12 to control leakage of cooling air or other coolant from the cold air supply into the hot gas stream.

A thermal insulating material or a thermal barrier coating (TBC) 80 can be applied to various portions of the vane assembly 10. For instance, the TBC 80 can be applied over at least a portion of the outer peripheral surface 36 of the airfoil portion 12. In one embodiment, the TBC 80 can be applied over at least a portion of the outer peripheral surface 36 of the airfoil portion 12, such as shown in FIG. 6. One or more layers of the TBC 80 can be applied to the radially inwardly facing surfaces 82 of the shrouds 16, 14, as shown in FIG. 8. In one embodiment, the thermal barrier coating 80 can be a friable graded insulation (FGI), which is known in the art. Various examples of possible coatings are disclosed in U.S. Pat. Nos. 6,676,783; 6,670,046; 6,641,907; 6,287,511; 6,235,370; and 6,013,592, which are incorporated herein by reference.

Figure 13:
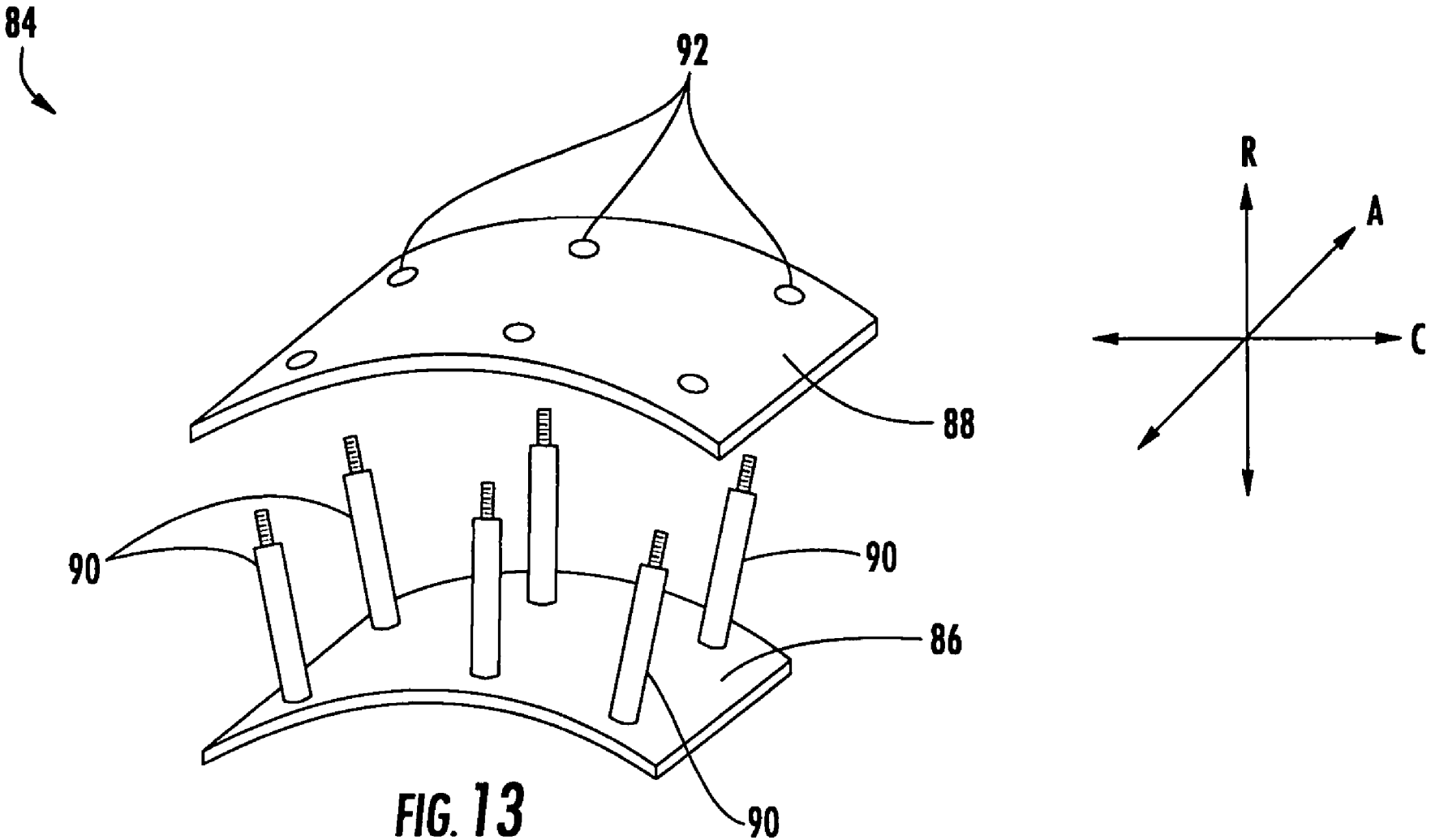
FIG. 13 is an isometric view of a metallic substructure for a vane assembly according to embodiments of the invention.

A vane assembly according to aspects of the invention can be secured together and supported by a substructure 84, an example of which is shown in FIG. 13. The substructure 84 can include an inner shroud support 86 and an outer shroud support 88. Each of the shroud supports 86, 88 can be arcuate in conformation. Each of the inner and outer shrouds 86, 88 can be a single continuous piece, or at least one of the shroud supports 86, 88 can be segmented. Preferably, the substructure 84 is made of metal. The inner shroud support 86 and the outer shroud support 88 can sandwich the shrouds 14, 16 and airfoil portion 12 of the vane assembly 10, as shown in FIG. 6. The inner shroud support 86 can be substantially adjacent to the radially inner face 87 of the inner shroud 14. Likewise, the outer shroud support 88 can be substantially adjacent to the radially outer face 89 of the outer shroud 16. Preferably, the metallic substructure 84 can carry and support an interstage seal housing. For example, the inner shroud support 86 can be adapted to connect to such a housing.

The inner and outer shroud supports 86, 88 can host a single airfoil 12 or multiple airfoils 12. In the case of multiple airfoils 12, the airfoils 12 can be circumferentially arrayed between the inner and outer shroud supports 86, 88. For each airfoil 12, one or more fasteners 90 can extend between the inner and outer shroud supports 86, 88. The fasteners 90 can be, for example, rods, bars, spars, bolts, or any of the possibilities mentioned in connection with the fasteners 46 above. Preferably, the fasteners 90 are configured with shoulders, as discussed earlier.

The fasteners 90 can be circumferentially spaced about the airfoil. For each circumferential location, there can be more than one fastener 90 provided, such as for multi-segment airfoils 12. For example, as shown in FIG. 13, there can be the fasteners 90 provided in pairs. In such case, the fasteners 90 can be substantially axially aligned.

The fasteners 90 can pass through the airfoil 12. The ends of the fasteners 90 can be secured to the inner and outer shroud supports 86, 88 in any of a number of ways. For instance, the ends of the fasteners 90 can be secured by threaded engagement directly into openings 92 in the shroud supports 86, 88 or can extend through the openings 92 and be secured using a retainer, such as a nut or other fastener, as shown in FIG. 6. In one embodiment, the fasteners 90 can be fixed to one of the shrouds 86, 88 by, for example, welding or casting as a single piece. For example, the fasteners 90 can be fixed to the inner shroud support 86, as shown in FIG. 13.

It should be noted that the individual airfoil segments 12 do not carry the mechanical loads imposed on the vane assembly 10 during engine operation. Rather, the airfoil segments 12 only carry the pressure loads of the turbine. The metallic substructure 84 can carry the tensile mechanical loads on the vane assembly 10. Thus, the substructure 84 is well suited for airfoil segments 12 made of ceramic or CMC. While not ideal for carrying mechanical loads, ceramics and CMCs can serve as heat shields to protect the metallic substructure from the thermal loads of the turbine. Use of the substructure 84 is not limited to ceramic and CMC airfoils 12 as the substructure 84 can be used in combination with airfoils 12 made of any materials, such as metals.

Figure 14:
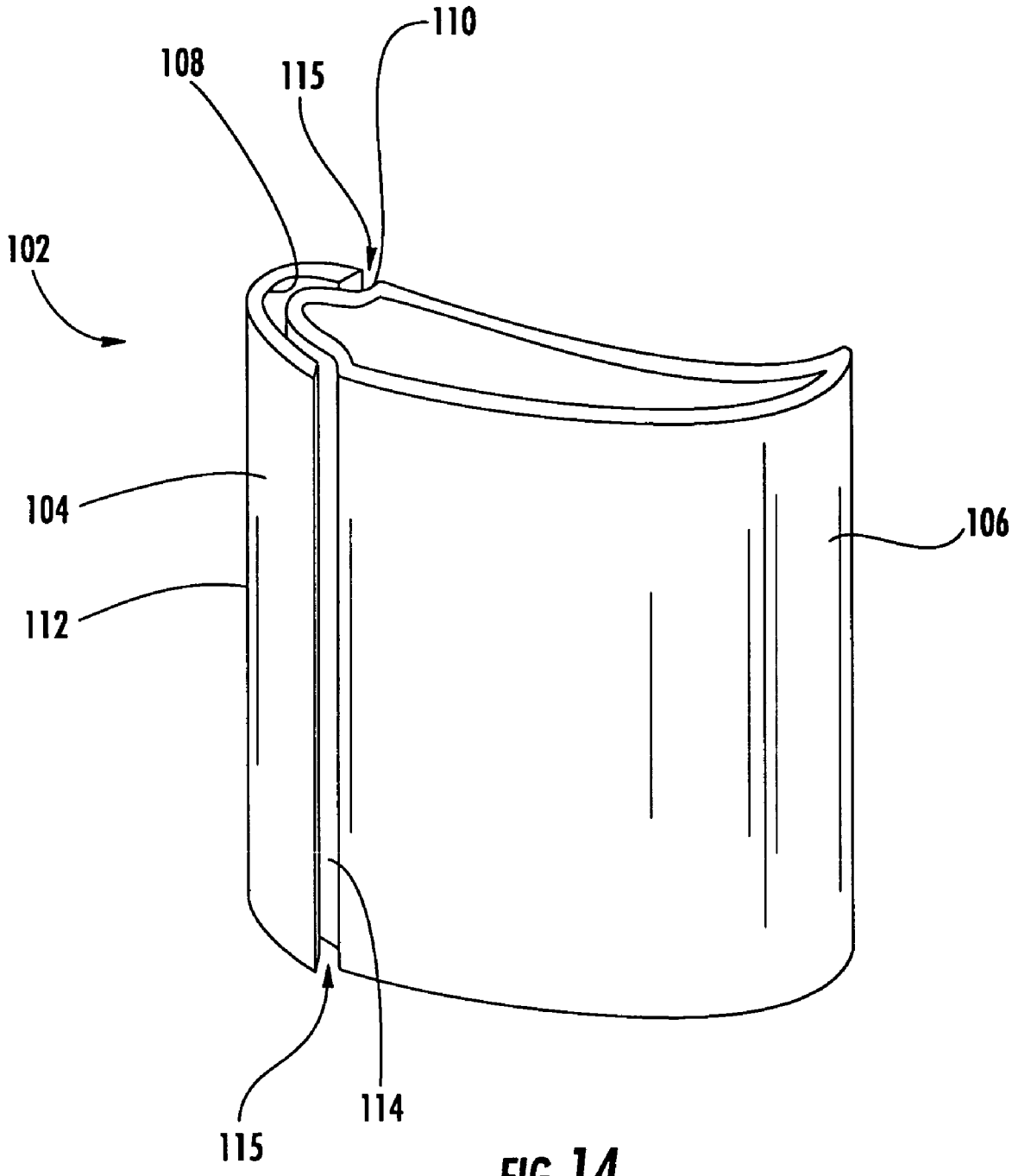
FIG. 14 is an isometric view of an airfoil portion of a vane assembly according to embodiments of the invention.
Figure 16:
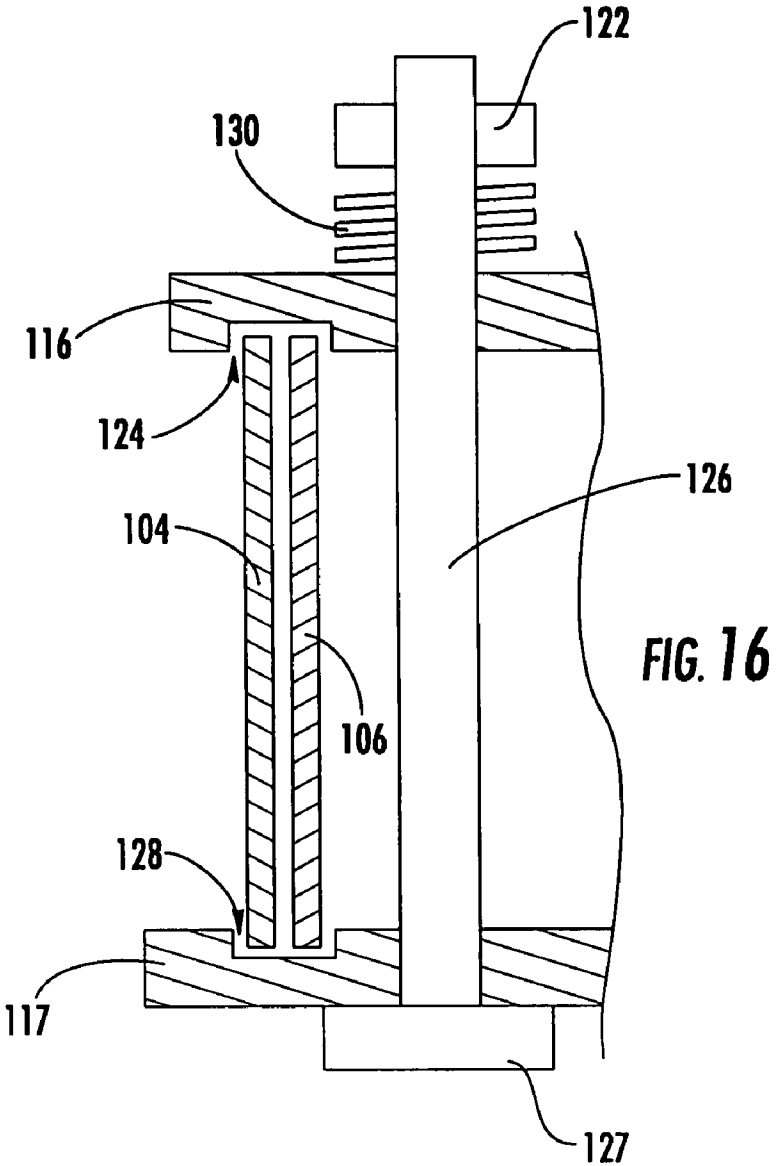
FIG. 16 is a cross-sectional view of a vane assembly according to embodiments of the invention, showing another manner of attaching the airfoil portion to the shrouds.
Figure 15:
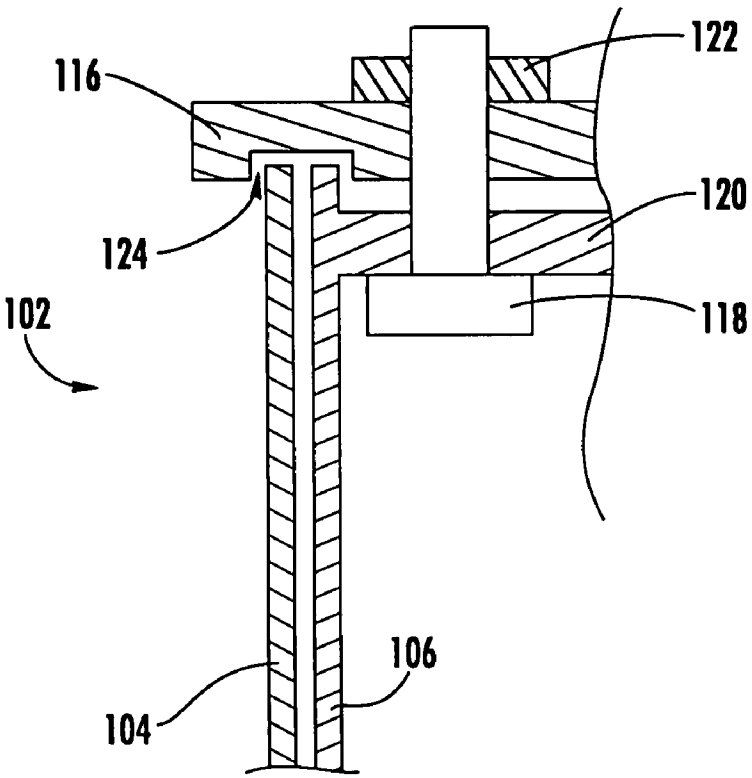
FIG. 15 is a cross-sectional view of a vane assembly according to embodiments of the invention, showing one manner of attaching the airfoil portion to a shroud.

It will be appreciated that numerous vane assemblies are encompassed within the scope of the invention. One embodiment of a multi-piece vane assembly 100 according to aspects of the invention is shown in FIGS. 14-16. Referring to FIG. 14, an airfoil portion 102 of the vane assembly 100 can include at least two segments. In one embodiment, the airfoil portion 102 can include a forward segment 104 and an aft segment 106. It will be understood that aft segment 106 may be formed by a single segment or more than one segment. The forward segment 104 can be substantially arcuate or generally C-shaped in conformation.

Material selection for the forward and aft segments 104, 106 can be tailored to meet the expected thermal loads at various locations on the airfoil portion 102. In one preferred embodiment, the forward segment 104 is made of a single crystal material, such as metal, to withstand the higher temperatures experienced at and near the leading edge 112 of the airfoil portion 102. The aft airfoil segment 106 can be made of CMC or metal.

The forward segment 104 has an interface surface 108. The aft segment 106 has an interface surface 110. Again, the interface surfaces 108, 110 can be positioned substantially proximate to each other to define a gap 114 therebetween. The interface surfaces 108, 110 can be configured to mechanically interlock to provide structural attachment of the forward and aft segments 104, 106. Such mechanical attachment can be achieved by, for example, a sliding dovetail or hinge and pin arrangement. In some instances, the forward and aft segments 104, 106 can be joined in other ways, such as by welding. The forward and aft segments 104, 106 can be joined along their radial seams 115 in a non-structural manner so as to substantially seal the gap 114 to prevent hot gas migration therethrough. In one embodiment, such sealing can be achieved by brazing the forward and aft segments 104, 106 along at least the radial seams 115. Other manners of substantially sealing the gap 114 have been discussed earlier.

The airfoil assembly 102 can be operatively associated with the shrouds in any of the manners previously discussed. Additional examples of attachment are shown in FIGS. 15 and 16. Referring to FIG. 15, the radially outer end of the airfoil portion 102 can be attached to the outer shroud 116 by a fastener, such as a bolt 118. The bolt 118 can pass through the radial outer end 120 of the aft airfoil segment 106 and the shroud 116. A retainer, such as a nut 122, can engage the bolt 118 so as to secure the airfoil portion 102 to the outer shroud 116. It should be noted that the bolt 118 need not extend through the entire airfoil segment 106. The shroud 116 can provide a recess 124 to receive at least a portion of the forward and aft airfoil segments 104, 106. As noted earlier, the recess can substantially restrain the airfoil assembly 102 in the axial and circumferential directions.

Another manner of attaching the airfoil portion 102 to both the inner shroud 117 and the outer shroud 116 is shown in FIG. 16. The radially outer ends of the forward and aft segments 104, 106 can be received in a recess 124 provided in the outer shroud 116. Likewise, the radially inner ends of the forward and aft segments 104, 106 can be received in a recess 128 provided in the inner shroud 117. The recesses 124, 128 can be substantially airfoil-shaped so as to correspond to the outer contour of the airfoil assembly 102. Thus, the airfoil assembly 102 can be trapped between the inner shroud 117 and the outer shroud 116.

An elongated fastener 126 can pass radially through the aft segment 106. In one embodiment, the fastener 126 can have a head 127 that can engage the inner shroud 117. The other end of the fastener can be closed with a retainer, such as a nut 122. A spring or spring washer 130 can be provided between the nut 122 and the outer shroud 116 so as to provide radial compliance.

Any of the foregoing vane assemblies according to embodiments of the invention can be provided in a turbine engine in any of a number of ways. For instance, for any row of blades in the turbine, at least one vane according to embodiments of the invention can be provided. In instances where two or more modular vanes according to aspects of the invention are provided in a row of vanes, the vanes can be substantially identical in terms of material selection, subcomponents used, and arrangement, but one or more of the vanes can vary in at least one of these respects. Similarly, the arrangement of the vanes according to embodiments of the invention in one row of vanes may or may not be substantially identical to other rows of vanes.

A vane assembly according to embodiments of the invention can provide numerous advantages over prior vane constructions. For instance, due to the smaller sizes of the individual components of the vane assembly, the manufacturing of these components is less complicated, which allows for improved manufacturing yields. Further, secondary processes, such as coating or machining, can be simplified as well. While there may be an increase in the assembly costs associated with the modular vane, these costs are expected to be more than offset by savings in the other manufacturing operations.

The modular approach can also facilitate and economize vane repair. During an outage, a damaged vane assembly can be removed from the turbine and disassembled. An individual section having damage can be removed and replaced with a new sub-component. The repaired vane can be reassembled and reinstalled in the turbine. Thus, it will be appreciated that a modular vane assembly according to aspects of the invention can support reduced outage times by enabling rapid on-site repair and avoiding the need to replace an entire unitary vane or rework such a vane offsite. It will also be appreciated that the subcomponents can be stocked in inventory as opposed to keeping entire vanes on hand for replacement. Thus, the total cost of the parts in inventory can be reduced.

The modular design allows for the use of dissimilar materials in the vane as opposed to a single material. A modular vane according to aspects of the invention can facilitate the selective implementation of suitable materials to optimize component life, cooling air usage, aerodynamic performance, and cost. Moreover, because the vane is made of several smaller subcomponents, desirable materials, which were rendered infeasible in a large unitary vane construction, may be available for use in some of the subcomponents.

These and other benefits can be realized with a vane assembly according to embodiments of the invention. The foregoing description is provided in the context of two possible systems for attaching a metal aft airfoil segment to a forward segment made of a dissimilar material. It will be appreciated that aspects of the invention can be applied in connection with various vane designs, including, for example, U.S. Pat. Nos. 6,709,230 and 6,514,046, which are incorporated herein by reference. It will of course be understood that the invention is not limited to the specific details described herein, which are given by way of example only, and that various modifications and alterations are possible within the scope of the invention as defined in the following claims.

What is claimed is:

1. A modular vane assembly comprising:

a radially inner shroud;

a radially outer shroud;

an airfoil formed by at least two airfoil segments including at least a forward airfoil segment and an aft airfoil segment, the forward airfoil segment defining the leading edge of the airfoil assembly, wherein the aft airfoil segment is made of metal and defines the trailing edge of the airfoil assembly, the airfoil having a radial inner end and a radially outer end, the airfoil including an outer peripheral surface defining a leading edge and a trailing edge, wherein at least one of the inner shroud, the outer shroud and the airfoil is a separate part; and a fastener extending substantially radially through the at least one airfoil segment and into engagement with the inner and outer shrouds, wherein the airfoil is secured between the inner and outer shrouds.

2. The assembly of claim 1 wherein the other airfoil segments and the shrouds are made of CMC.

3. The assembly of claim 1 wherein the aft airfoil segment has opposing ends, wherein one end of the aft airfoil segment is fixed to a respective shroud and the opposite end of the aft airfoil segment is received within a recess in the other shroud, and wherein the forward airfoil segment is secured to the shrouds by the fastener.

4. A modular vane assembly comprising:

a radially inner shroud;

a radially outer shroud;

an airfoil formed by at least two airfoil segments including at least a forward airfoil segment and an aft airfoil segment, the forward airfoil segment defining the leading edge of the airfoil assembly, the aft airfoil segment defining the trailing edge of the airfoil assembly, the airfoil having a radial inner end and a radially outer end, the airfoil including an outer peripheral surface defining a leading edge and a trailing edge, wherein at least one of the inner shroud, the outer shroud and the airfoil is a separate part; and a fastener extending substantially radially through the at least one airfoil segment and into engagement with the inner and outer shrouds, wherein the airfoil is secured between the inner and outer shrouds, wherein each airfoil segment includes an interface surface, wherein the airfoil segments are positioned such that interface surfaces are substantially proximate to each other so as to define a gap therebetween, and further comprising a seal placed within the gap, whereby flow migration through the gap is substantially minimized.

5. A modular vane assembly comprising:

a radially inner shroud;

a radially outer shroud;

an airfoil formed by at least two airfoil segments including at least a forward airfoil segment and an aft airfoil segment, the forward airfoil segment defining the leading edge of the airfoil assembly, the aft airfoil segment defining the trailing edge of the airfoil assembly, the airfoil having a radial inner end and a radially outer end, the airfoil including an outer peripheral surface defining a leading edge and a trailing edge, wherein at least one of the inner shroud, the outer shroud and the airfoil is a separate part; and a fastener extending substantially radially through the at least one airfoil segment and into engagement with the inner and outer shrouds, wherein the airfoil is secured between the inner and outer shrouds, wherein each airfoil segment includes an interface surface, wherein the airfoil segments are positioned such that interface surfaces are substantially proximate to each other so as to define a gap therebetween, wherein the interface surfaces of the airfoil segments are substantially correspondingly stepped, whereby a tortuous flow path through the gap is formed.

6. A modular vane assembly comprising:

a radially inner shroud;

outer shroud;

an airfoil formed by at least two airfoil segments including at least a forward airfoil segment and an aft airfoil segment, the forward airfoil segment defining the leading edge of the airfoil assembly, the aft airfoil segment defining the trailing edge of the airfoil assembly, the airfoil having a radial inner end and a radially outer end, the airfoil including an outer peripheral surface defining a leading edge and a trailing edge, wherein at least one of the inner shroud, the outer shroud and the airfoil is a separate part; and a fastener extending substantially radially through the at least one airfoil segment and into engagement with the inner and outer shrouds, wherein the airfoil is secured between the inner and outer shrouds, wherein each airfoil segment includes an interface surface, wherein the airfoil segments are positioned such tat interface surfaces are substantially proximate to each other so as to define a gap therebetween, wherein the substantially proximate airfoil segments define a radial seam, wherein the airfoil segments are welded along the radial seam, whereby flow ingress into the gap is substantially impeded.

7. A vane assembly comprising:

a radially inner shroud;

a radially outer shroud; and an airfoil having a radially inner end and a radially outer end, the airfoil being formed by at least an arcuate forward airfoil segment and a second airfoil segment, the forward airfoil segment defining the leading edge of the airfoil, wherein the forward airfoil segment is positioned substantially proximate to and attached to the second airfoil segment, wherein the airfoil is secured between the radially outer shroud and the radially inner shroud, wherein each of the inner and outer shrouds includes a recess shaped to receive the respective radial ends of the airfoil, wherein the radial ends of the airfoil are received within the recesses, wherein a fastener extends though the second segment and engages the shrouds, and further including a retainer and a fastener, wherein at least one end of the fastener is closed with the retainer and the radial spring is disposed between the retainer and one of the shrouds.

* * * * *